US005145560A

United States Patent [19]

Grenlulnd

[11] Patent Number: 5,145,560

[45] Date of Patent: Sep. 8, 1992

[54] METHOD AND APPARATUS FOR MONITORING AND CONTROLLING THE VELOCITY OF A JET ALONG THE SLICE OPENING OF A PAPERMAKING MACHINE

[75] Inventor: Wesley E. Grenlulnd, Puyallup, Wash.

[73] Assignee: Weyerhaeuser Company, Tacoma, Wash.

[21] Appl. No.: 459,070

[22] Filed: Dec. 29, 1989

[51] Int. Cl.[5] ..... D21F 1/06

[52] U.S. Cl. ..... 162/198; 162/259; 162/262; 162/263; 162/344; 425/145

[58] Field of Search ..... 162/198, 259, 262, 263, 162/336, 344; 264/40.2, 40.7; 425/145

[56] References Cited

U.S. PATENT DOCUMENTS

| | | | |
|---|---|---|---|
| 3,609,318 | 2/1969 | Anderson | 73/73 |
| 3,620,914 | 11/1971 | Rocheleau | 162/259 |
| 3,703,436 | 2/1970 | Rice | 162/253 |
| 3,711,688 | 1/1973 | Stout et al. | 162/259 |
| 3,936,665 | 2/1976 | Donoghue | 162/DIG. 10 |
| 4,086,130 | 4/1978 | Justus | 162/198 |
| 4,207,141 | 6/1980 | Seymour | 162/263 |
| 4,374,703 | 2/1983 | Lebeau et al. | 162/259 |
| 4,539,074 | 9/1985 | Stenberg | 162/259 |
| 4,633,252 | 12/1986 | Bachman et al. | 342/115 |
| 4,675,077 | 6/1987 | Cook | 162/344 |
| 4,680,089 | 7/1987 | Aral et al. | |
| 4,746,405 | 5/1988 | Lisnyansky et al. | 162/253 |

FOREIGN PATENT DOCUMENTS

| | | | |
|---|---|---|---|
| 82108478.7 | 6/1983 | European Pat. Off. | |
| 3535849 | 9/1987 | Fed. Rep. of Germany | |
| 63-42991 | 2/1988 | Japan | |
| 182491 | 7/1988 | Japan | 162/262 |

OTHER PUBLICATIONS

Harris, J., "Interrogating Flow Fields with Radar and Laser Sources," Measurement and Control, vol. III, No. 11, 1974.

Hamid, A. and Stuchly, S. S., "Microwave Doppler--Effect Flow Monitor," *IEEE Trans. Ind. Electron. and Control Instrum.*, IECI-22, No. 2, May 1975, pp. 224-228.

Parker, R. R. and Huffman, F. N., "Flow: Its Measurement and Control in Science and Industry" ISA, vol. I, May 1971, pp. 999-1006.

*Primary Examiner*—Kenneth M. Schor
*Assistant Examiner*—Charles K. Friedman
*Attorney, Agent, or Firm*—Klarquist, Sparkman, Campbell, Leigh & Whinston

[57] ABSTRACT

The jet velocity along a slice opening of a papermaking machine is monitored at plural locations to provide a jet velocity profile. This jet velocity profile may be adjusted to more closely match a reference velocity profile for the jet. Preferably, microwave doppler-effect velocity sensors are utilized for sensing a jet velocity. In one specific embodiment of the invention, preamplifier and automatic gain control circuitry is used to minimize variations in the sensed signal due to changing conditions of the jet.

19 Claims, 4 Drawing Sheets

FIG. 5
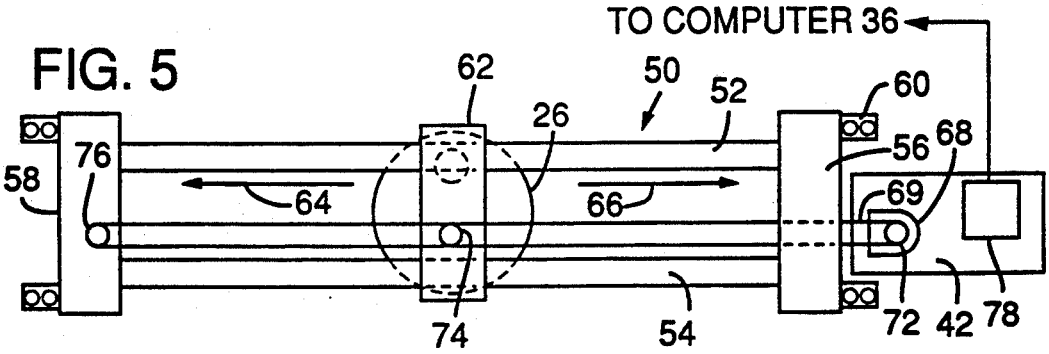
FIG. 6
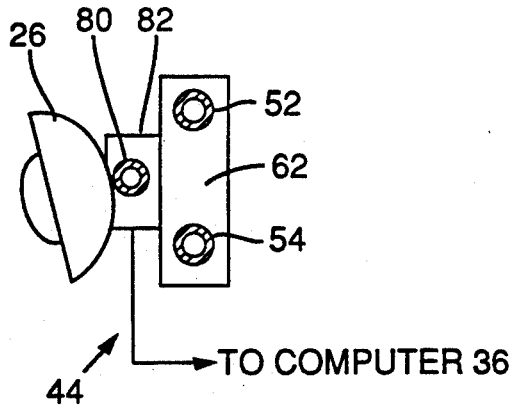
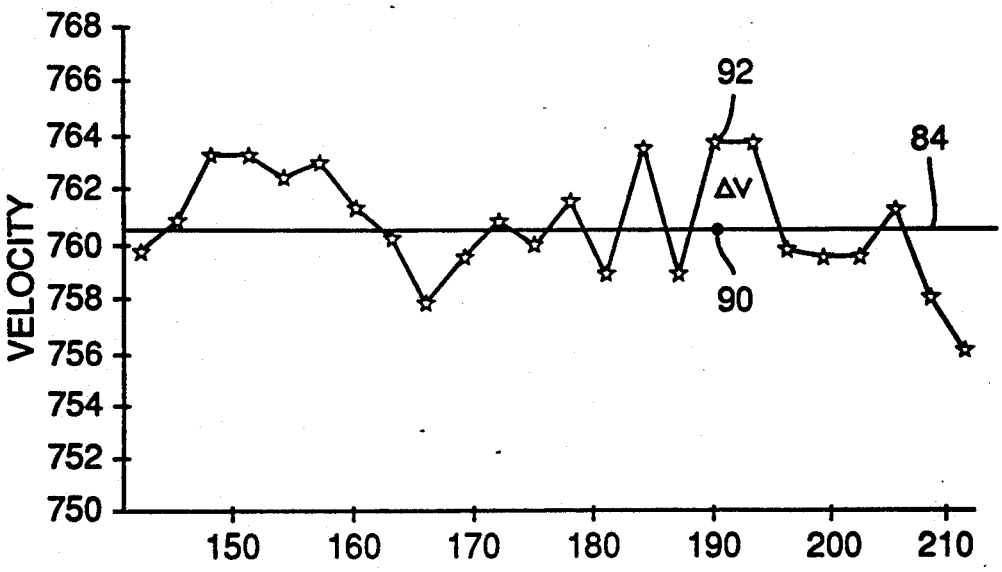
FIG. 7

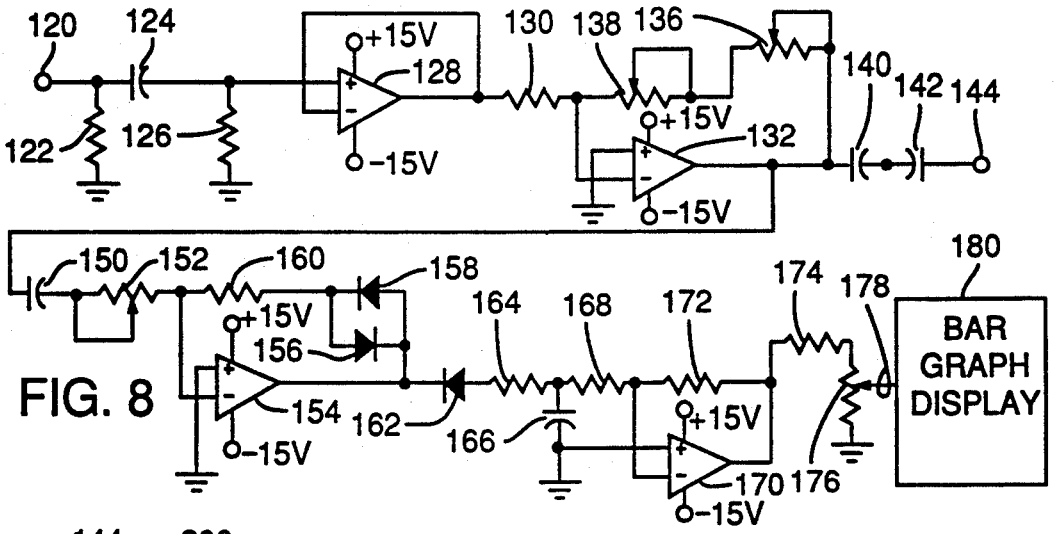
FIG. 8
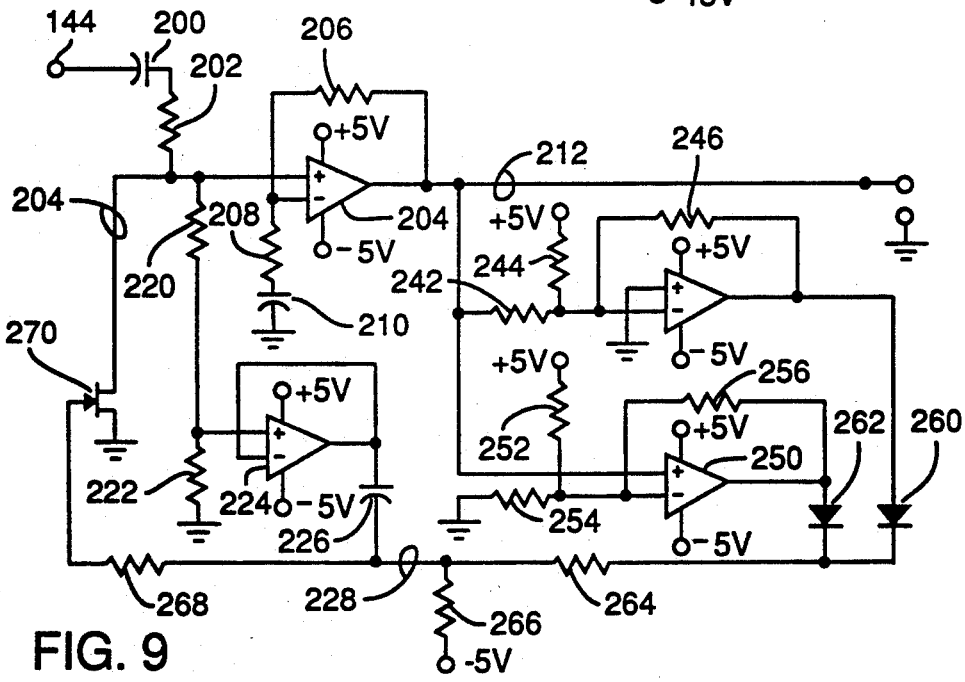
FIG. 9
FIG. 10
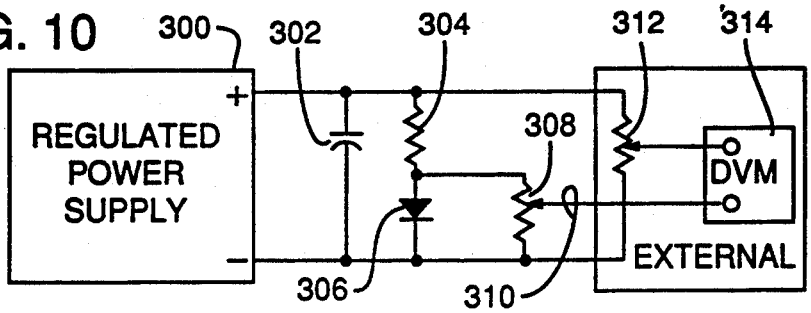

METHOD AND APPARATUS FOR MONITORING AND CONTROLLING THE VELOCITY OF A JET ALONG THE SLICE OPENING OF A PAPERMAKING MACHINE

BACKGROUND OF THE INVENTION

The present invention relates to monitoring the velocity of a jet of a papermaking machine along a slice opening and for controlling the jet velocity.

Conventional papermaking machines have a head box which contains a slurry of liquid and paper forming fibers, along with other additives, used in the formation of web or sheet products. For purposes of this description, and without limiting the generality of the invention, these products will be collectively referred to as paper, with this term being broadly construed to encompass any product made by depositing a slurry of liquid and fibers into a sheet or web. Papermaking machines have an elongated slice opening through which the slurry is deposited onto a moving wire or screen which assists in separating the fiber from the liquid, inasmuch as the liquid passes through the screen. This web or mat of fibers is then typically passed through a dryer for drying the product into the finished paper. Actuators are conventionally used for adjusting the slice opening to permit the passage of greater or lesser amounts of slurry from the slice opening to, for example, change the basis weight or quality and grade of the paper being produced. Both computer and manually controlled actuators have been used. These actuators are typically positioned at various locations along the slice opening for adjusting the slice opening at these locations as required. Due to manufacturing tolerance and other variations, the actuators are not necessarily set at the same position as they are used to adjust the slice opening to compensate for these factors.

In one conventional approach, the basis weight of the paper is tested following drying by the dryer. In the event the basis weight varies transversely across the width of the paper, the various actuators are adjusted in an attempt to adjust the slice opening to bring the basis weight to a more uniform level. However, many paper machine operators are reluctant to allow the adjustment of slice opening actuators during the manufacture of a particular grade of paper because of the risk of further reducing the quality of the resulting product. In addition, by sensing the basis weight downstream from a dryer, adjustments are less quickly accomplished in response to a variation in paper quality. U.S. Pat. No. 4,374,703 of Lebeau et al. is one example of a control system for a papermaking machine head box having a basis weight sensor downstream from a drying section.

The effect of jet velocity on the quality of the resulting paper has been previously recognized. In U.S. Pat. No. 4,086,130 of Justus, pressure transducers are positioned in a head box for use in monitoring the velocity of the slurry or stock flowing through channels of a multi-channel paper machine. The total head at the slice opening is regulated in response to the pressure transducer signals to maintain a desired spouting or jet velocity. The use of pressure transducers for the indirect measurement of jet velocity does not account for variations in jet velocity along the length of a slice opening. In addition, the adjustment of the head to control velocity can be a relatively slow reacting velocity control approach.

In a prior art previously marketed system sold by Beloit Corporation, an optical sensor was used for monitoring the jet velocity at a single location along the slice of a papermaking machine. To function, the optical sensor was positioned to nearly contact the jet. Because of the adverse environmental conditions at this location, purge water was directed toward the optical sensor for cleaning purposes.

Another example of a prior art papermaking machine control system is disclosed in European Published Patent Application No. 82108478.7 to Helleur. This patent application describes slice actuators which are heated to expand and move the edge of an adjoining portion of a slice opening to control the size of the opening. A magnetic field is used to heat the actuators. Adjustment of the slice opening for purposes of controlling caliper, basis weight, opacity, show-through, and other properties related to the uniformity of web structure is mentioned. This patent also mentions tying of devices for sensing these properties to a closed-loop system to control the slice orifice and thus the desired property of the final web. Without providing any explanation, this patent also mentions that devices could also measure the components or other properties issuing from the slice, e.g., dry/wet substance, jet velocity, etc.

There is some discussion in the literature of the use of microwave doppler-effect flow monitors for monitoring the surface velocity of fluids. For example, an article entitled "Interrogating Flow Fields With Radar and Laser Sources" by Harris, Volume 3, No. 11, 1970, in *Measurement and Control,* is one example. An article entitled "Microwave Doppler-Effect Flow Monitor" by Hamid, published in Volume IECI-22, 1975, of the *IEEE Transactions On Industrial Electrical and Control Instrumentation* is another example. However, these references do not suggest the use of microwave velocity sensors in the harsh environments associated with the papermaking machines and in particular where signals from a microwave sensor would be expected to vary as a result of variations in reflections from the paper forming slurry. Variations in signal reflections can arise, for example, when the grade or basis weight of paper is changed and from turbulence in the jet at the slice opening.

The use of microwave-doppler-effect velocity measuring devices in other applications is also known. For example, U.S. Pat. No. 4,633,252 to Bachman et al. describes such a mechanism for measuring the velocity of a vehicle. In the specific embodiment described in this patent, preamplifier and automatic gain control circuitry are employed.

Therefore, a need exists for an apparatus and method for more effectively monitoring the velocity of a jet at the slice opening of a papermaking machine and for controlling jet velocity. In addition, a particular need exists for a device for monitoring and controlling jet velocity at plural locations along a slice opening.

SUMMARY OF THE INVENTION

In accordance with the present invention, an apparatus and method for monitoring a jet of liquid and paper forming fibers delivered from an elongated slice opening of a papermaking machine is disclosed in which a jet velocity sensor means is positioned external to the jet for monitoring the jet velocity at plural locations along the slice opening. The jet velocity at these plural locations is determined from the sensor output signals. A jet velocity profile may be displayed and comprises the jet velocities at various positions along the length of the slice opening.

In accordance with another aspect of the present invention, the slice opening may be adjusted at various locations to adjust the jet velocity at such locations to assist in controlling the quality of the resulting paper product.

In addition, the jet velocity profile resulting from such measurements may be compared with a reference velocity profile with the slice opening being adjusted to bring the jet velocity profile to closer correspondence to the reference velocity profile.

As still another aspect of the present invention, at least one microwave velocity sensor may be used to generate velocity output signals associated with a location along the slice opening. The jet velocity associated with the location from which the velocity output signals are generated is then determined from the velocity output signals. The jet velocity may be displayed. Also, the jet velocity may be used in controlling the slice opening at such location.

In addition, although plural microwave velocity sensors may be used, at least one such sensor may be mounted for movement relative to the slice opening. This sensor is used in obtaining velocity output signals corresponding to the jet velocity at various positions along the slice opening. In addition, the angle, relative to horizontal, at which the microwave velocity sensor directs microwave signals to the jet may be adjusted. Angular adjustments may be made, for example, to more optimally direct the microwave signals toward the jet. Typically the microwave signals are directed to the jet at a location where the jet emerges from the slice opening. However, if a microwave transparent head box is used, the signals may be directed toward a location within the head box and adjacent to the slice opening.

The velocity signals from the microwave sensor are processed by circuitry for use in producing a display of the jet velocity at the monitored locations. The signals may also be used in controlling actuators for adjusting the slice opening to thereby adjust the jet velocities.

A preferred form of processing circuitry includes an automatic gain control circuit for receiving the sensor output signals and for producing gain control circuit output signals of a substantially constant peak-to-peak amplitude. Because of this substantially constant output, rapid analysis of these signals can be achieved using a spectrum analyzer. The analyzer output signals from the spectrum analyzer may be used by processing means, such as a computer, for computing the jet velocity. The computed jet velocities for various locations along the slice opening may be displayed as a jet velocity profile for the slice opening. In addition, reference velocity signals corresponding to jet velocity at particular locations along the jet, or a reference velocity profile signal, may be provided to the processing means. These reference signals may be compared with the computed jet velocity signals and used in adjusting the slice opening to bring the computed jet velocities into closer correspondence with the velocities represented by the reference signals.

In addition, a preamplifier circuit means may be used for amplifying the velocity sensor output signals prior to the delivery of such signals to the automatic gain control circuit means. This preamplifier circuit means may include a display which is typically monitored as a microwave velocity sensor is positioned or aimed to direct microwave signals toward the jet. The position of the microwave velocity sensor is adjusted to a position where the displayed signals are at a desired magnitude.

The apparatus may also include position sensor means for sensing the transverse position of the microwave velocity sensor means along the slice opening. Position signals generated by the position sensor means may be fed to the processing means for determining the position of the sensor along the slice opening. The processing means associates the computed jet velocity for such location with the sensed location of the microwave velocity sensor.

In a specific embodiment of the present invention, at least one microwave velocity sensor is mounted for sliding movement along a line parallel to the longitudinal axis of the slice opening. In addition, the microwave sensors may be mounted for tilting to adjust the angle of the sensor with respect to horizontal to aim the microwave sensor at the jet. Although the microwave velocity sensor may be left at a fixed angular position once it is set, it may also be moved in the event operating conditions are changed. In this latter case, an angular position sensor may be used to sense the angular position of the microwave velocity sensor and transmit angular position indicating signals to the processing means. These signals may also be used in computing the jet velocity.

It is accordingly one object of the present invention to provide a more effective method and apparatus for monitoring jet velocities along a slice opening of a papermaking machine.

Another object of the present invention is to provide an improved mechanism for controlling the velocity of a jet along a slice opening to provide paper of a more uniform quality.

These and other objects, features and advantages of the present invention will become apparent with reference to the following description and drawings.

BRIEF DESCRIPTION OF THE DRAWINGS

FIG. 5 is an elevational view of one form of mechanism for supporting a velocity sensor for movement relative to the slice opening.

FIG. 6 is a side elevational view, partially in section, of the mechanism of FIG. 5 showing one form of a mechanism for adjusting the angular position of the velocity sensor relative to horizontal and thus relative to the slice opening.

FIG. 7 is a velocity profile generated from actual measurements of jet velocity along a portion of a head box slice opening utilizing the microwave velocity sensor and the processing circuitry described below in connection with FIGS. 4, 8, and 9. In addition, FIG. 7 illustrates one reference velocity profile which is shown as a constant velocity line across the slice of the machine.

Figure 4:
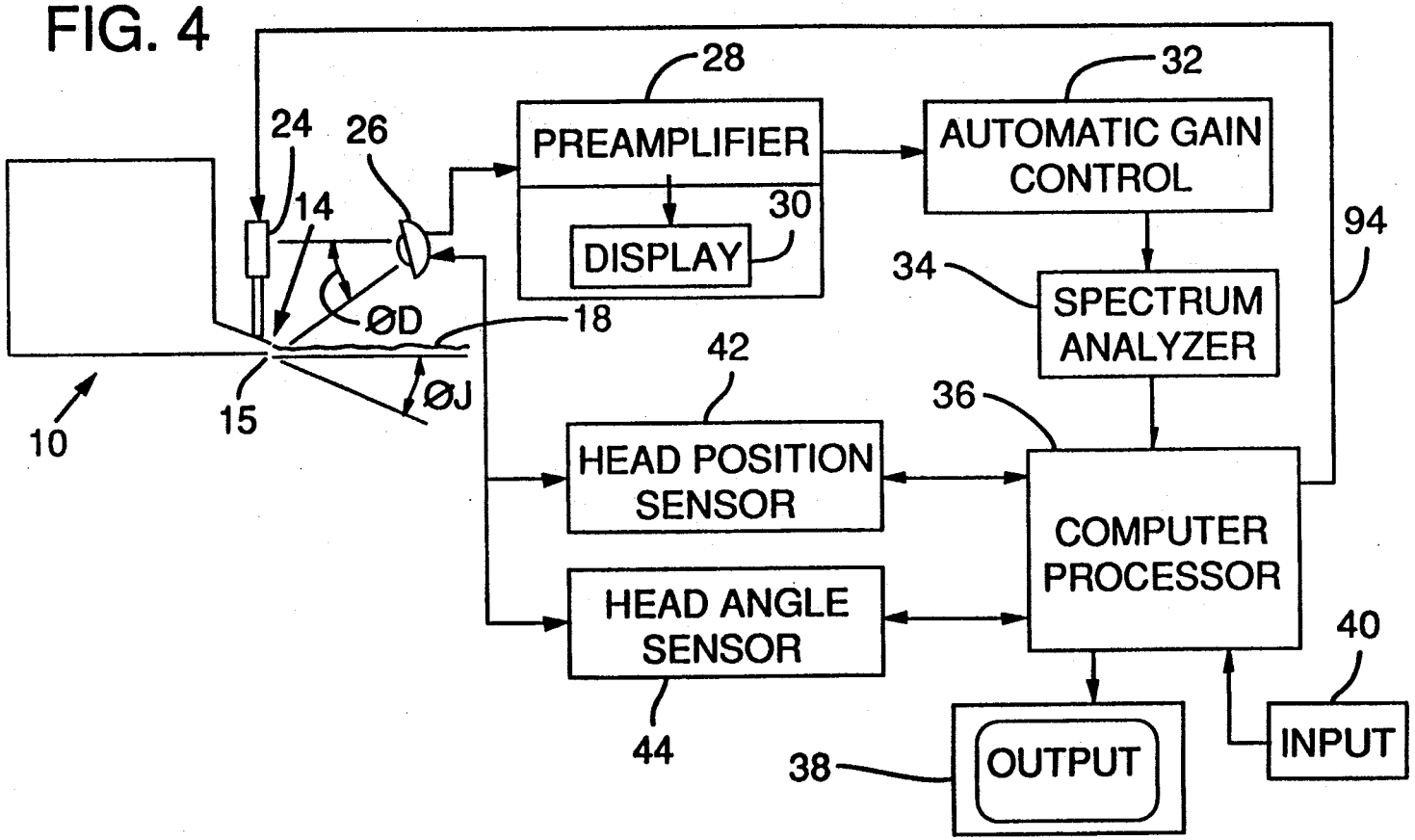
FIG. 4 is a block diagram of one embodiment of a jet velocity sensing apparatus in accordance with the present invention.

FIG. 8 is an electrical schematic diagram of a form of preamplifier circuit used in the embodiment of FIG. 4.

FIG. 9 is an electrical schematic diagram of a form of automatic gain control circuit used in the embodiment of FIG. 4.

FIG. 10 is an electrical schematic diagram of one form of head position sensor circuit used in the embodiment of FIG. 4.

DETAILED DESCRIPTION OF THE PREFERRED EMBODIMENT

Figure 1:
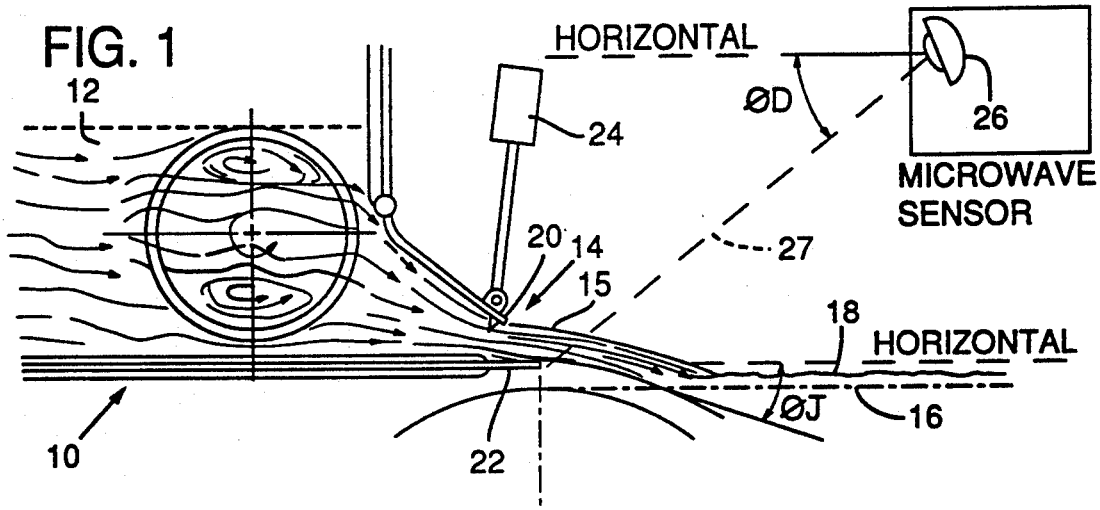
FIG. 1 is a side elevation view, partially in section, of a head box of a papermaking machine with a conventional slice opening control actuator and showing a velocity sensor in position for sensing the velocity of the jet exiting from the slice opening.
Figure 2:
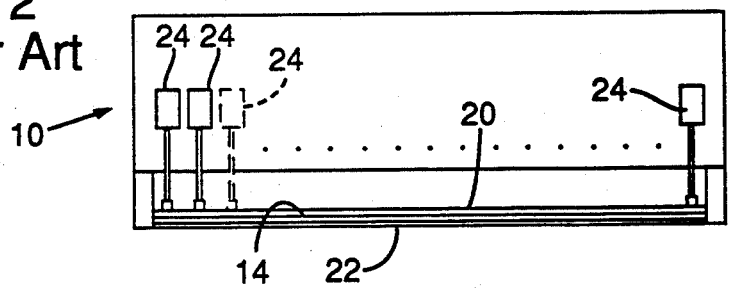
FIG. 2 Prior Art
FIG. 2 is a front schematic elevation view of the head box of FIG. 1 showing plural actuators positioned at spaced locations along the length of the slice opening.
Figure 3:
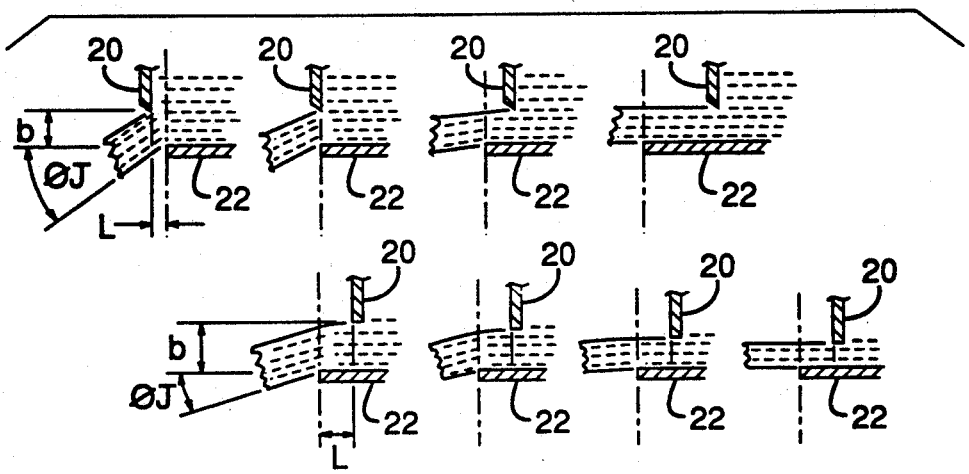
FIG. 3 Prior Art
FIG. 3 is a schematic illustration of a mechanism for adjusting the angle at which a jet is delivered from a head box by respectively adjusting the relative positions of the upper and lower lips bounding the slice opening.

With reference to FIGS. 1-3, a conventional head box 10 of a papermaking machine is shown. A slurry 12 of liquid and paper forming fibers is contained within the head box and is typically agitated to provide a uniform mixture of the fibers and liquid. Although this description proceeds with reference to paper forming fibers, this designation is for convenience only. That is, the term paper forming fibers and paper are meant to include webs and sheets of all types formed by depositing a mixture of fibers and liquid through an elongated opening during the web or sheet forming process. An elongated slice opening 14 provides an exit through which a jet 15 of liquid and paper forming fibers exits from the head box. The liquid fiber slurry is deposited onto a moving screen or wire 16 to form a mat 18. The wire assists in separating liquid from the mat inasmuch as liquid passes through the wire and leaves the fibers deposited thereon. This wet-laid mat is then typically fed to a dryer, not shown. The slice opening 14 is bounded by respective upper and lower lips 20, 22. Although variable, papermaking machines have slice openings that are typically from about 160 inches to about 400 inches long.

Plural slice opening actuators are typically positioned along the length of the slice opening for adjusting the size of the opening at such positions. Exemplary actuators are indicated at 24 in FIGS. 1 and 2. These slice actuators may be positioned, for example, at six-inch increments along the slice opening, although other suitable spacings may be used. One form of a suitable actuator is an Accu Ray 1180 MicroPlusMicroSet Linear Stepper Slice Actuator from Combustion Engineering Company. Although the invention is not limited to any specific type of actuator, remotely controlled actuators are preferred.

In general, assuming a substantially uniform mix of fibers and liquid in the head box 10, a constant velocity across the full length of the slice opening generally results in a finished paper product with a substantially constant basis weight and quality. For a given basis weight and quality of paper, due to variations in tolerances and other paper machine characteristics, set points of the various actuators typically differ and are empirically determined and recorded. The actuator set points are frequently varied when the basis weight of the paper is changed. However, velocity variations across the length of a papermaking machine slice opening can occur during paper formation. In addition, the set of actuator set points for a given basis weight of paper may require changing over time for optimum results. By directly monitoring the velocity of the jet across the length of the slice opening, adjustments in set points can be rigidly and effectly made to more accurately control the quality of the paper. In addition, prompt adjustments can be made because paper quality is being determined from measurements taken at the wet end of the papermaking machine, as opposed to after drying of the paper. In addition, in some applications it may be desirable to have paper of a nonuniform basis weight across its width. In such cases, it would be desirable to adjust the jet velocity across the slice opening to produce paper with a desired variation in basis weight.

In accordance with the present invention, at least one velocity sensor 26 is positioned to sense the velocity of the jet along the slice opening. Preferably the velocity sensing is accomplished at plural locations along the slice opening. As explained more fully below, a jet velocity profile across the slice opening may be generated from these measurements and displayed for use in monitoring jet velocity. In addition, these measurements can also be used for controlling the slice opening to adjust the measured jet velocity profile to, for example, more closely correspond to a desired or reference velocity profile.

As illustrated in FIG. 1, a preferred form of velocity sensor comprises a continuous wave microwave doppler-effect radar velocity sensor 26. One suitable sensor is Model Number RGSS101 from Magnavox Corporation of Fort Wayne, Ind. The analog signal generated by this sensor is processed and used in determining the jet velocity. Although other types of velocity sensors may be used, such as a laser doppler-effect sensor, it has been found that microwave velocity sensors are particularly well suited for the harsh environment of papermaking machine head boxes. In addition, it has been found that these microwave velocity sensors may be used even though turbulence in the jet at the slice opening and variations in paper grade causes the analog output signals from such sensors to vary.

As shown in FIG. 1, the sensor 26 generates microwaves which travel substantially the direction indicated by line 27. These signals are reflected back to sensor 26 from the jet. The sensor 26 is oriented such that line 27 is at an angle $\phi D$ with respect to horizontal to direct the microwave signals toward the jet. In addition, as is also shown in FIG. 1, the jet exits from the slice opening at an angle $\phi J$ with respect to horizontal. The angles $\phi D$ and $\phi J$ are utilized as explained below in computing the jet velocity from the output signals generated by the microwave velocity sensor 26. It should also be noted that separate sending and receiving units, instead of the combined unit 26, may be used.

As shown in FIG. 3, the angle $\phi J$ may be varied in a conventional manner. One method of adjusting $\phi J$ is to adjust the position of the upper slice opening lip 20 relative to the lower slice opening lip 22. Again, as explained below, changes in $\phi J$ may be considered in the computation of jet velocity using the system of the present invention.

With reference to FIG. 4, the signals from velocity sensor 26 are delivered to an optional preamplifier circuit 28. Assuming the previously mentioned Magnavox radar velocity sensor is used, the output frequency of these velocity signals is 24.125 GHz $\pm$50 MHz. In addition, the beam width of the microwave signal from such a velocity sensor is 10° at the 3 db points. The preamplifier circuit 28, described in greater detail below in connection with FIG. 8, provides a 40 db signal amplification to the velocity signals. The preamplifier 28 preferably includes a display 30 for providing a visual display of signals which correspond to the output signals from the preamplifier circuit. This visual display is typically monitored as the microwave velocity sensor 26 is aimed toward the jet 15. When the display 30 indicates a maximum output, or at least a minimum threshold magnitude, confirmation is provided that the velocity sensor 26 is being aimed at the area of interest of the jet 15. The velocity sensor 26 may then be fixed at this angle with the velocity sensor being mounted for scanning movement in a horizontal direction along the slice opening.

As parameters of a papermaking machine change, such as the speed of the wire and basis weight, the magnitude of the signal from the velocity sensor 26, and thus from the preamplifier circuit 28, will change. Although compensation may be made for these variations, in accordance with the present invention, an automatic gain control circuit 32 is preferably used to automatically account for these changes. The automatic gain control circuit 32, described in greater detail below in connection with FIG. 9, is designed to produce a constant 1 volt peak-to-peak signal over a 45 db change in the input signal level. Therefore, even though machine conditions may change, the scale of the system remains the same for determining the center frequency of the velocity signals inasmuch as the output from the automatic gain control circuit remains at this substantially constant peak-to-peak level.

The signals from the automatic gain control circuit 32 are fed to a conventional spectrum analyzer 34 for determination of the center frequency of the delivered signal. One example of a suitable spectrum analyzer is Model Number 3561, Spectrum Analyzer from Hewlett-Packard Corporation.

The output from spectrum analyzer 34 is delivered to a computer processor 36 with a display, such as a monitor 38, and an input mechanism, such as a keyboard 40. One suitable computer is a Hewlett-Packard Company Personal Computer 9816 with an analog to digital card for receiving the various inputs.

A head position sensor 42, one form of which is described below in connection with FIG. 10, provides signals to the computer 36 for use in determining the position of the microwave velocity sensor 26 along the slice opening. Consequently, the computer is capable of associating the computed jet velocities with the position of the slice opening from which velocity signals, upon which the computations are made, are obtained. In addition, a head angle sensor mechanism 44, such as explained below, is coupled to the computer and to the velocity sensor for determining $\phi D$ for use in the velocity computations. If $\phi D$ remains fixed, input device 40 may be used to input $\phi D$ to the computer 36. In such a case, the head angle sensor 44 is typically eliminated. In addition, $\phi J$ is known for given application and can be fed into computer 36 via the keyboard 40.

The jet velocity in feet per minute is computed as follows:

$$\textit{Jet Velocity} = [\textit{Center Frequency} \div df^* \cos(\phi J + \phi D)] \times [(5280/60)].$$

In this formula, $\phi J$ is the angle of the jet relative to horizontal, as explained above. In addition, $\phi D$ is the radar angle of depression relative to horizontal, as explained above. Also df* is 71.898933 (microwave hertz per mile per hour). In the above equation, the center frequency is determined from the 3 db points of the signal delivered to the spectrum analyzer by subtracting the low frequency 3 db point from the high frequency 3 db point and dividing the resultant by 2. In addition, df is computed in a conventional manner and is a function of the doppler-effect, and takes into account the fundamental operating frequency of the velocity sensor 26. Furthermore, df*cos ($\phi J + \phi D$) compensates for the fact that the velocity sensor 26 is not in line with the material being delivered from the jet.

The velocity sensor 26 again is typically shifted relative to the slice opening to measure the jet velocity at plural positions or locations along the slice opening. For example, a frame 50, as shown in FIG. 5, may be used to support the velocity sensor 26 in position for monitoring the jet 15. The frame 50 includes upper and lower rails 52, 54 which are rigidly interconnected at their ends by end pieces 56, 58. These end pieces may be provided with flanges 60 for securely mounting the frame 50 to a support structure with the sensor 26 oriented in the desired direction. A sliding block 62 is slidably mounted to the respective rails 52, 54 for sliding in the respective directions indicated by arrows 64, 66. The frame 50 is preferably supported with the arrows 64, 66 parallel to the longitudinal axis of the slice opening. As a result, with velocity sensor 26 mounted to block 62 and as the block 62 is slid in the direction of arrows 64 66, the velocity sensor 26 is moved to direct microwave signals to plural positions along the slice opening. Equivalently, continuous monitoring of velocity along the slice opening may be accomplished. The velocity sensor 26 may be driven by a motor 68 to its various positions. Motor 68 may comprise a stepper motor for driving a belt 69 about gears 72, 74 and 76 for moving the velocity sensor 26 in the respective directions of arrows 64, 66. However, in one preferred form of the invention, motor 68 drives a gear chain drive mechanism with the gear position being sensed by a circuit 78, described in greater detail below in connection with FIG. 10 Circuit 78 is coupled to computer 36 for providing position indicating signals to the computer for the purpose of determining the position of the velocity sensor along the slice opening.

With reference to FIG. 6, one form of head angle sensor 44 is indicated. As shown in this figure, the microwave velocity sensor 26 is rigidly clamped to a shaft 80 of a motor 82. The motor 82 and shaft are mounted to the sliding block 62. A commercially available inclinometer, such as an Acustar Inclinometer from Sperry Corporation, is coupled to shaft 80 for sensing the angular position of the shaft and thus the angle $\phi D$ (see FIG. 4). The signal from the inclinometer which may, for example, be calibrated at 60 millivolts per degree, is fed to an analog to digital converter card input to computer 36. As mentioned above, after the angle $\phi D$ is initially set for a maximum signal at the display 30 of the preamplifier 28, the angle normally remains constant.

With reference to FIG. 7, a visual display of measured jet velocities across a section of a slice opening of an actual papermaking machine is shown. In this display, velocity measurements have been taken approximately every three inches along the displayed section of the slice opening. In addition, this display includes a superimposed reference or desired velocity profile 84. As can be seen at the location 190, a difference $\Delta V$ exists between point 90 of the reference jet velocity profile and the computed jet velocity 92 at the same location. The reference velocity profile or reference velocity signals corresponding to desired jet velocities at particular locations may be entered into the computer 36 by keyboard input 40 (FIG. 4). The computer may then compute the $\Delta V$ values. In the event computer controlled actuators 24 are being used, a control signal may be delivered from computer 36 along a line 94 (FIG. 4) to the actuator 24 associated with the location wherein there is a difference between the computed jet velocity and reference jet velocity. These differences may be ignored unless they exceed a predetermined magnitude. The control signals on line 94 control the actuators to adjust the slice opening. That is, the jet velocity at the location of an actuator may be increased or decreased, depending upon whether the slice opening is narrowed or widened at this location by the actuator in response to the control signal. Thus, in connection with FIG. 7, the actuator associated with location 190 may be controlled to open the slice opening at this location to reduce the jet velocity to more closely match the reference jet velocity at this location. Thus, the actuator 24 is operated to reduce the magnitude of $\Delta V$, for example to within a predetermined threshold.

In this manner, the jet velocity profile along a slice opening may be monitored. In addition, differences between the measured jet velocity and a reference jet velocity for particular locations may be minimized to produce a desirable high quality paper.

Referring now to FIG. 8 and FIG. 9 schematic diagrams of the preamplifier 28, the display circuit 30 and the automatic gain control circuit 32 as shown in FIG. 4 are described in detail. Specific values of the various components are not given in this detailed discussion unless they are essential to an understanding of the function of the particular circuit. For a complete disclosure, however, typical values for the resistors and capacitors used in the circuits of a preferred embodiment of the invention are given in the accompanying charts appended to this section Chart 1 gives typical values of the fixed resistors used in the circuits of FIG. 8 and FIG. 9. Chart 2 gives typical values of the adjustable resistors shown in FIG. 8 and FIG. 9. Chart 3 lists typical values of the capacitors referenced in FIG. 8 and FIG. 9.

Referring to FIG. 8, the output of the microwave velocity sensor 26 (FIG. 4) is fed to input node 120. A termination matching resistor 122 and a blocking capacitor 124, operating in conjunction, pass the alternating current portion of the signal to the non-inverting terminal or positive side of a first operational amplifier 122. A dropping resistor 126 is connected to ground from the input signal line to amplifier 128. Amplifier 128, in one embodiment of the invention, is a LM 833 device manufactured by National Semiconductor Corporation and is configured into a voltage follower by feeding the output to the inverting or negative input. This provides a high degree of isolation between the signal input at node 120 and the remainder of the circuit.

The signal is then fed through resistor 130 to the inverting or negative input of operational amplifier 132. Amplifier 132 is again, in one embodiment of the invention, a LM 833 device manufactured by National Semiconductor Corporation but is configured as an amplifier. The non-inverting input or the positive input is connected to ground. The output is fed through an adjustable resistor 136 which is adjustable between 0–20K ohms. A second adjustable resistor 138, adjustable between 0–1K ohms is in series with resistor 136. The feed back signal from resistor 138 is fed to the inverting or negative input of amplifier 132. The gain of this amplifier section is the summation of the value of the resistance of resistor 136 and 138 divided by the value of the resistance of resistor 130. Adjustment of resistor 136 therefore causes a course adjustment of the gain of amplifier 132 while adjustment of resistor 138 causes a fine adjustment of the gain of amplifier 132. In a preferred embodiment of the invention, the gain of the preamplifier is set to 40 db dynamic range to set the threshold of the system.

The output of amplifier 132 is fed to line 134. The signal passes through blocking capacitors 140 and 142 to node 144 where it is connected to an automatic gain circuit as will be explained below. Line 134 also feeds a bar graph driver circuit.

The purpose of the bar graph driver circuit is to provide sufficient current and voltage to drive the bar graph display 180 without loading or affecting the signal on node 144. This is accomplished by feeding the signal from line 134 through capacitor 150 to an adjustable resistor 152 mounted in series with capacitor 150. The output from adjustable resistor 152 is fed to the inverting or negative input of operational amplifier 154 which, in one embodiment of the invention, is a LM 324 device manufactured by National Semiconductor Corporation. The non-inverting or positive input of amplifier 154 is connected to ground. The feedback from the output of amplifier 154 is fed through diode 156 and diode 158 which are arranged in a back-to-back arrangement to act as a rectifier. Any positive signal on the output of amplifier 154 is inverted so that it is passed as a negative signal while the negative signals are also passed as negative signals. These rectified signals pass through resistor 160 back to the inverting input or negative input of amplifier 154 as a feedback signal. The amplitude of the signal to be rectified is set by adjusting the adjustable resistor 152.

Blocking diode 162 is in line with the output of amplifier 154 to pass only the negative signal to the last amplification stage. Prior to the last amplification stage an R-C filter composed of resistor 164 and capacitor 166 filters the signal to eliminate any high frequency noise which has been generated.

The last amplification stage for the bar graph driver circuit uses operational amplifier 170 which, in one embodiment of the invention, is a LM 324 device manufactured by National Semiconductor Corporation. The positive or non-inverting input of amplifier 170 is connected to ground. The negative or inverting input of amplifier 170 receives its input from the R-C filter through resistor 168. The output of amplifier 170 has a feedback circuit through resistor 172 to the negative input of amplifier 170. Resistor 168 and resistor 172 are both 470K ohm resistors thus giving the amplifier stage a unity gain but inverting the signal.

The output of amplifier 170 feeds resistor 174 and adjustable resistor 176 which are connected in series. Adjustable resistor feeds the signal to line 178 which feeds the bar graph 180. Bar graph 180 is an analog display device number NSM 3915 manufactured by National Semiconductor Corporation. Adjustable resistor 176 is adjusted so that the signal on line 178 is equal to the signal on node 144. In this manner the display on bar graph 180 is a visual representation of the actual signal being produced by the microwave velocity sensor 26. An operator may adjust the position of microwave velocity sensor 26 by observing the bar graph to achieve maximum signal strength when microwave velocity sensor 26 is properly adjusted on the slice opening 14 of the headbox 10.

It is desireable, in feeding a signal to spectrum analyzer 34, to insure that the gain of the system remains constant to prevent non-signal variables from affecting the output of spectrum analyzer 34. Several factors such as grade change and headbox angle can cause the gain of the system to vary. For these reasons an automatic gain circuit is provided as shown in FIG. 9. The output of the preamplifier is fed from node 144 through capacitor 200 and resistor 202 to line 204 which is connected to the positive or non-inverting input of operational amplifier 204, which in one embodiment of the invention, is a LM 444 device manufactured by National Semiconductor Corporation. A feedback signal from the output of amplifier 204 is fed through resistor 206 to the negative or inverting input of amplifier 204. The inverting input of amplifier 204 is also connected through resistor 208 and capacitor 210 to ground. The resistance values are chosen such that in a preferred embodiment of the invention, amplifier 204 has a fixed gain of 1.25. In order to obtain automatic gain control the input to amplifier 204 must be monitored and controlled. This is accomplished by a voltage follower circuit connected to the input of amplifier 240 and an inverting peak detector and a non-inverting peak detector connected to the output of amplifier 204 as will be explained below.

A voltage divider consisting of resistor 220 and 222 connected in series between line 204 and ground. A signal is taken from between resistor 220 and 222 and is fed to the positive or non-inverting input of amplifier 224. Amplifier 224, in one embodiment, is a LM 444 device manufactured by National Semiconductor Corporation and configured as a voltage follower by connecting the output to the negative or inverting input as a feedback signal. The output of amplifier 224 is fed through capacitor 226 to line 228. In this manner a signal equal to one half of the signal on line 204 is impressed on line 228. This forms a voltage follower circuit which follows and monitors the input to amplifier 204.

The output of amplifier 204 which is on line 212 is fed through resistor 242 to the negative or inverting input of amplifier 240. A pull-up resistor 244 fed by a five volt power supply biases this input so that only peak signals are detected. Amplifier 240, in one embodiment of the invention, is a LM 444 device manufactured by National Semiconductor Corporation and is configured as an amplifier by connecting the positive or non-inverting input to ground and feeding back the output signal through resistor 246 to the negative or inverting input. This creates an inverting peak detector and the resistance values are chosen to give a gain of 20. The output of this stage is fed through diode 260 and resistor 264 to line 228.

The signal on line 212 is also fed to the non-inverting input of amplifier 250. Amplifier 250 in one embodiment of the invention is a LM 444 device manufactured by National Semiconductor Corporation. Amplifier 250 is configured as a non-inverting peak detector by feeding the output back to the inverting or negative input to amplifier 250. A pull-up resistor 252 feeds a positive five volt voltage to the inverting input of amplifier 250 to give a positive bias to the input. A resistor 254 connects the inverting input of amplifier 250 to ground. The resistance values are chosen to produce a gain of 20 in the amplifier 250. The output signal from amplifier 250 is fed through diode 262 and resistor 264 to line 228.

Line 228 has a negative offset impressed upon it by a resistor 266 connected to a negative five volt power source. The combined signals on line 228 are fed through series resistor 268 to field effect transistor 270. As the voltage on the FET 270 rises the FET becomes conductive within the linear portion of its operating range thus passing a portion of the signal on line 204 to ground. Thus the FET 270 acts as a variable voltage divider to automatically control the gain on the automatic gain control circuit to around 49 db. This gain is greater than the 40 db gain of the preamplifier and gives 9 db of headroom to prevent clipping of the signal. The output on line 212 which is fed to the spectrum analyzer 34 is a constant one volt peak to peak signal with a varying frequency. The magnitude of the frequency response is the value required for the velocity equation. Maintaining a constant voltage output eliminates any error due to amplitude variation.

Chart 1

| Fixed Resistors | Typical Values (OHMS) |
|---|---|
| 122 | 50 |
| 126 | 47K |
| 130 | 100 |
| 160 | 510K |
| 164 | 1K |
| 168 | 470K |
| 172 | 470K |
| 174 | 2K |
| 202 | 47K |
| 206 | 43K |
| 208 | 690 |
| 220 | 47K |
| 222 | 47K |
| 242 | 10K |
| 244 | 43K |
| 246 | 200K |
| 252 | 39K |
| 254 | 13K |
| 256 | 200K |
| 264 | 22K |
| 266 | 5.1M |
| 268 | 680 |

Chart 2

| Adjustable Resistors | Typical Values (OHMS) |
|---|---|
| 136 | 0-20K |
| 138 | 0-1K |
| 152 | 0-100K |
| 176 | 0-10K |

Chart 3

| Fixed Capacitors | Typical Values (ufd) |
|---|---|
| 124 | .47 |
| 140 | 47 |
| 142 | 47 |
| 150 | .47 |
| 210 | 2.2 |
| 226 | 1 |

Referring now to FIG. 10 an alternte embodiment of the head position sensor 42 of FIG. 4 is shown. A regulated power supply 300 feeds a constant direct current voltage to a voltage divider circuit. A filter capacitor 302 filters out any alternating current noise which may have by-passed the regulated power supply 300. The voltage divider circuit is comprised of an adjustable resistor 312 in parallel with fixed resistor 304 in series with adjustable resistor 308. A diode 306 is connected between fixed resistor 304 and ground to act as an additional filter. The output signal on the wiper arm of adjustable resistor 312 is connected to the positive input of digital volt meter 314. The negative input of the digital volt meter 314 is connected to the wiper arm 310 of adjustable resistor 308.

The wiper arm 310 of adjustable resistor 308 is mechanically attached to sliding block 62 shown in FIG. 5 by a chain, cable, rod or other suitable attachment means. As sliding block 62 moves laterally, wiper arm 310 is progressed along adjustable resistor 308. Adjustable resistor 312 is adjusted to provide a linear change of voltage in respect to travel of the sliding block 62 and therefore microwave velocity sensor 26. A voltage change of 100 millivolts for a one inch travel of sliding block 62 has been found to be acceptable. Adjustable resistor 308 is set such that there is zero volts differential as read by the digital volt meter 314 when sliding block 62 is at one end of its travel and full voltage when the sliding block 62 is at the other end of its travel. Thus a 300 millivolt signal read by the digital volt meter 314 would indicate that the microwave velocity sensor 26 is three inches from one end of its travel.

The digital volt meter 314 converts the analog voltage signal into a digital signal which is fed to computer processor 36 shown in FIG. 4.

Having illustrated and described principles of my invention with reference to a preferred embodiment, it should be apparent to those of ordinary skill in the art that my invention may be modified in arrangement and detail without departing from such principles.

I claim as my invention all such modifications which fall within the scope of the following claims:

1. A method comprising:

providing a jet of liquid and paper forming fibers from an elongated slice opening of a paper making machine;

measuring the velocity of the jet at plural locations along the slice opening to generate a velocity profile corresponding to the jet velocity along the slice opening;

the measuring step comprising the steps of directing microwave signals from a microwave velocity sensor toward the jet at plural locations along the slice opening, receiving reflected microwave signals from the jet and producing sensor output signals shifted in frequency in accordance with the velocity of the jet at the plural locations;

sensing the position of the microwave velocity sensor and producing an electrical position signal output corresponding to the sensed position of the microwave velocity sensor;

processing the sensor output signals to produce velocity output signals corresponding to the jet velocity at the plural locations;

receiving the electrical position signal output and associating the computed jet velocity with the sensed position of the microwave velocity sensor; and displaying the velocity profile of the jet along the slice opening.

2. A method according to claim 1 including the step of comparing the measured velocity profile of the jet with a reference velocity profile.

3. A method according to claim 2 including the step of adjusting the velocity profile of the jet such that the measured velocity profile more closely matches the reference velocity profile.

4. A method comprising:

providing a jet of liquid and paper forming fibers from an elongated slice opening of a paper making machine;

measuring the velocity of the jet at first and second locations along the slice opening;

the measuring step comprising the step of directing microwave signals from a microwave velocity sensor toward the jet at the first and second locations, receiving microwave signals reflected from the jet at the first and second locations, and producing sensor output signals shifted in frequency in accordance with the velocity of the jet at the first and second locations;

sensing the position of the microwave velocity sensor and producing an electrical position signal output corresponding to the sensed position of the microwave velocity sensor;

processing the sensor output signals to produce velocity output signals corresponding to the jet velocity at the first and second locations;

receiving the electrical position signal output and associating the computed jet velocity with the sensed position of the microwave velocity sensor;

comparing the measured velocity of the jet at the first location with a first reference velocity at the first location;

comparing the measured velocity of the jet at the second location with a second reference velocity at the second location;

adjusting the velocity of the jet at the first location to more closely match the first reference velocity in the event the first measured and first reference velocities differ by a predetermined magnitude; and adjusting the velocity of the jet at the second location to more closely match the second reference velocity in the event the second measured and second reference velocities differ by a predetermined magnitude.

5. A method according to claim 4 in which the measuring step comprises the step of measuring the velocity of the jet at plural locations along the slice opening to provide a measured velocity profile of jet velocity along the slice opening, in which the comparing steps comprise the step of comparing the measured velocity profile with a reference velocity profile, and in which the adjusting steps comprise adjusting the velocity of the jet at various locations such that the measured velocity profile more closely matches the reference velocity profile.

6. An apparatus comprising:

means for providing a jet of liquid and paper forming fibers delivered from an elongated slice opening of a paper making machine;

at least one microwave velocity sensor means comprising means for directing microwave signals toward the jet at a first location and for receiving reflected microwave signals from the jet, the velocity sensor means also comprising means for producing a sensor output signal that is shifted in frequency in accordance with the velocity of the jet at the first location;

processing means for processing the sensor output signal to produce a velocity output signal corresponding to the jet velocity at the first location;

said microwave velocity sensor means comprising means for directing microwave signals toward the jet at plural locations along the slice opening, the velocity sensor means producing sensor output signals shifted in frequency in accordance with the velocity of the jet at the plural locations;

the processing means comprising means for processing the sensor output signals to produce velocity output signals corresponding to the jet velocity at the plural locations, means for providing reference signals to the processing means, each reference signal corresponding to a velocity associated with a respective position along the slice opening, the processing means comprising means for computing the jet velocity at each location from the sensor output signals associated with each location, the processing means also comprising means for comparing the computed jet velocity associated with each location with the reference velocity associated with each location and for producing an actuator control signal corresponding to the difference between the jet velocity and reference jet velocities at each location, actuator means responsive to the actuator control signal for selectively adjusting the slice opening at each location to adjust the jet velocity to more closely match the reference jet velocity for each location along the slice opening; and the processing means comprising automatic gain control circuit means for receiving the sensor output signals and for producing gain control circuit output signals of a substantially constant peak-to-peak amplitude, spectrum analyzer means for receiving the gain control circuit output signals and for producing analyzer output signals corresponding to the center frequency of the gain control circuit output signals, and means for receiving the analyzer output signals and for computing jet velocity corresponding to the analyzer output signals and thus to the jet velocity at the plural locations.

7. An apparatus comprising:

means for producing a jet of liquid and paper forming fibers from an elongated slice opening of a paper making machine;

at least one microwave velocity sensor means comprising means for directing microwave signals toward the jet at a first location and for receiving reflected microwave signals from the jet, the velocity sensor means also comprising means for producing a sensor output signal that is shifted in frequency in accordance with the velocity of the jet at the first location;

processing means for processing the sensor output signal to produce a velocity output signal corresponding to the jet velocity at the first location;

said microwave velocity sensor means comprising means for directing microwave signals toward the jet at plural locations along the slice opening, the velocity sensor means producing sensor output signals shifted in frequency in accordance with the velocity of the jet at the plural locations; and the processing means comprising means for processing the sensor output signals to produce velocity output signals corresponding to the jet velocity at the plural locations, the processing means also comprising automatic gain control circuit means for receiving the sensor output signals and for producing gain control circuit output signals of a substantially constant peak-to-peak amplitude, spectrum analyzer means for receiving the gain control circuit output signals and for producing analyzer output signals corresponding to the center frequency of the gain control circuit output signals, and means for receiving the analyzer output signals and for computing jet velocity corresponding to the analyzer output signals and thereby to the jet velocity at the plural locations.

8. An apparatus according to claim 7 including display means coupled to the means for receiving the analyzer output signals and for computing jet velocity, said display means comprising means for displaying a velocity profile comprising the jet velocity at the plural locations along the slice opening.

9. An apparatus according to claim 7 including preamplifier circuit means for receiving and amplifying the sensor output signals prior to delivery of such signals to the automatic gain control circuit means, the preamplifier circuit means including means for displaying the sensor output signals.

10. An apparatus according to claim 9 including means for moving the microwave velocity sensor means relative to the slice opening.

11. An apparatus comprising:

means for providing a jet of liquid and paper forming fibers from an elongated slice opening of a paper making machine;

at least one microwave velocity sensor means comprising means for directing microwave signals toward the jet at a first location and for receiving reflected microwave signals from the jet, the velocity sensor means also comprising means for producing a sensor output signal that is shifted in frequency in accordance with the velocity of the jet at the first location, the microwave velocity sensor means also including means for directing microwave signals toward the jet at plural locations along the slice opening, the velocity sensor means producing sensor output signals shifted in frequency in accordance with the velocity of the jet at the plural locations;

position sensor means for sensing the position of the microwave velocity sensor means and for producing a position signal output corresponding to the sensed position of the microwave velocity sensor means; and processing means for processing the sensor output signal to produce a velocity output signal corresponding to the jet velocity at the first location, the processing means also for processing the sensor output signals to produce velocity output signals corresponding to the jet velocity at the plural locations, the processing means also including means for receiving the position signal output and for associating the computed jet velocity with the sensed position of the microwave velocity sensor means.

12. An apparatus according to claim 11 including means for supporting the microwave sensor means for sliding movement in a first direction parallel to the slice opening to direct the microwave signals to plural locations along the slice opening.

13. An apparatus according to claim 12 including angle sensing means for sensing the angle of the directed microwave signals relative to horizontal, the angle sensing means comprising means for delivering signals corresponding to the sensed angle to the processing means, the processing means comprising means for incorporating the sensed angle into the computation of jet velocity.

14. An apparatus according to claim 11 including means for providing reference signals to the processing means, each reference signal corresponding to a velocity associated with a respective position along the slice opening, the processing means comprising means for computing the jet velocity at each location from the sensor output signals associated with each location, the processing means also comprising means for comparing the computed jet velocity associated with each location with the reference velocity associated with each location and for producing an actuator control signal corresponding to the difference between the jet velocity and reference jet velocities at each location, actuator means responsive to the actuator control signal for selectively adjusting the slice opening at each location to adjust the jet velocity to more closely match the reference jet velocity for each location along the slice opening.

15. An apparatus according to claim 11 for also controlling the velocity of the jet along the slice opening, the apparatus including slice actuator means for selectively adjusting the slice opening at various locations to thereby adjust the jet velocity at such locations, the apparatus also including slice actuator control means responsive to the velocity signals for controlling the slice actuator means to adjust the jet velocity profile.

16. An apparatus according to claim 15 including means for providing reference signals corresponding to a reference jet velocity profile, the control means comprising means for comparing the reference signals to the velocity signals and for controlling the slice actuator means to adjust the jet velocity profile to correspond to the reference velocity profile.

17. An apparatus according to claim 11 including means for receiving the velocity signals and for displaying a jet velocity profile of jet velocity along the slice opening in response to the received velocity signals.

18. An apparatus comprising:

means for providing a jet of liquid and paper forming fibers delivered from an elongated slice opening of a paper making machine;

microwave velocity sensor means comprising means for directing microwave signals toward the jet at plural locations along the slice opening, the velocity sensor means also comprising means for producing sensor output signals shifted in frequency in accordance with the velocity of the jet at the plural locations;

processing means for processing the sensor output signals to produce velocity output signals corresponding to the jet velocity at the plural locations, the processing means comprising automatic gain control circuit means for receiving the sensor output signals and for producing gain control circuit output signals of a substantially constant peak-to-peak amplitude, spectrum analyzer means for receiving the gain control circuit output signals and for producing analyzer output signals corresponding to the center frequency of the gain control circuit output signals, means for receiving the analyzer output signals and for computing the jet velocity corresponding to the analyzer output signals and thus to the jet velocity at the plural locations; and means for supporting the microwave sensor means for sliding movement in a first direction parallel to the slice opening to direct the microwave signals to plural locations along the slice opening;

means for moving the microwave means relative to the slice opening; and display means coupled to the processing means for displaying a velocity profile of jet velocity at the plural locations across the slice opening.

19. An apparatus according to claim 18 including preamplifier circuit means for receiving and amplifying the sensor output signals prior to delivery of such signals to the automatic gain control circuit means, the preamplifier circuit means including means for displaying the sensor output signals.

* * * * *

UNITED STATES PATENT AND TRADEMARK OFFICE

CERTIFICATE OF CORRECTION

PATENT NO. : 5,145,560

DATED : September 8, 1992

INVENTOR(S) : Wesley E. Grenlund

It is certified that error appears in the above-indentified patent and that said Letters Patent is hereby corrected as shown below:

On the title page, item [75] Inventor: Wesley E. "Grenlulnd", should read —Grenlund—

Column 8, line 24, "64 66," should be —64, 66,—
line 36, "FIG. 10 Circuit" should be —FIG. 10. Circuit—

Column 9, line 34, "section Chart" should be —section. Chart—

Column 15, claim 7, line 42, "producing" should be --providing—

Signed and Sealed this

Fourth Day of January, 1994

Bruce Lehman

*Attest:*

BRUCE LEHMAN

*Attesting Officer*

*Commissioner of Patents and Trademarks*